US006220460B1

(12) United States Patent
Pan

(10) Patent No.: US 6,220,460 B1
(45) **Date of Patent: *Apr. 24, 2001**

(54) BATHROOM RACK

(75) Inventor: Chia-Cheng Pan, Chan Hua Hsien (TW)

(73) Assignee: Sun Tai Bathroom Equipment Company, Ltd., Chan Hua Hsien (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/395,705

(22) Filed: Sep. 14, 1999

(51) Int. Cl.[7] ..... A47H 1/14

(52) U.S. Cl. ..... 211/87.01; 248/222.52; 248/251; 211/105.1

(58) Field of Search ..... 211/105.1, 105.2, 211/87.01, 123; 403/187; 248/303, 304, 251, 309.1, 315, 224.7, 220.21, 220.22, 222.52, 261–262, 254; 4/559, 576.1, 577.1

(56) References Cited

U.S. PATENT DOCUMENTS

| | | | | |
|---|---|---|---|---|
| 1,799,558 | * | 4/1931 | Howard | 211/105.1 |
| 1,838,935 | * | 12/1931 | Fixsen | 248/222.52 |
| 2,936,148 | * | 5/1960 | Gralewicz | 211/105.1 |
| 4,062,512 | * | 12/1977 | Arnold | 248/309.1 |
| 4,714,222 | * | 12/1987 | Kiesel et al. | 248/558 |
| 4,979,713 | * | 12/1990 | Bell | 248/251 |
| 5,022,104 | * | 6/1991 | Miller | 248/251 |
| 5,026,013 | * | 6/1991 | Robbins | 248/251 |
| 5,065,923 | * | 11/1991 | Hoefer et al. | 220/694 |
| 5,071,099 | * | 12/1991 | Kuo | 248/251 |
| 5,076,523 | * | 12/1991 | Wang | 248/251 |
| 5,186,427 | * | 2/1993 | Semchuk | 248/251 |
| 5,402,977 | * | 4/1995 | Korfgen et al. | 248/222.52 |
| 5,664,751 | * | 9/1997 | Lan | 248/251 |
| 5,730,413 | * | 3/1998 | Chen | 248/303 |
| 5,875,903 | * | 3/1999 | Chen | 211/105.1 |
| 5,893,544 | * | 4/1999 | Chen | 248/220.21 |
| 5,931,427 | * | 8/1999 | Pan | 248/251 |
| 6,012,692 | * | 1/2000 | Meck | 248/251 |
| 6,042,072 | * | 3/2000 | Chi-Nan | 248/222.52 |

* cited by examiner

*Primary Examiner*—Jerry Redman
*Assistant Examiner*—Jennifer E. Novosad
(74) *Attorney, Agent, or Firm*—Jiawei Huang; J.C. Patents

(57) ABSTRACT

A bathroom rack comprises a base, a holding rod, and a cover. The base is provided with a plurality of first retaining portions and through holes. The base is fastened with the bathroom wall by a plurality of bolts which are fastened onto the bathroom wall via the through holes. The holding rod has a fastening end and an article holding end. The fastening end is provided with a plurality of second retaining portions. The holding rod is fastened with the base such that the second retaining portions of the fastening end of the holding rod are engaged with the first retaining portions of the base. The cover is joined with the base such that the holding rod is located between the base and the cover.

13 Claims, 15 Drawing Sheets

BATHROOM RACK

FIELD OF THE INVENTION

The present invention relates generally to a bathroom equipment, and more particularly to a bathroom rack.

BACKGROUND OF THE INVENTION

As shown in FIG. 1, a bathroom rack of the prior art is intended for use in holding towels and is formed of two fastening bodies 1, two covers 2, and a rod 3. The two fastening bodies 1 are attached to the bathroom wall at an interval by a plurality of fastening bolts 4 which are fastened onto the bathroom wall. The fastening bolts 4 are concealed by the covers 2. The two fastening bodies 1 are respectively provided with a retaining hole 5 for retaining one end of the rod 3 which is held between the two fastening bodies 1.

As shown in FIG. 2, a bathrobe rack has a fastening body 6, which is fastened with the wall by a plurality of fastening bolts and is concealed by a cover 7, The fastening body 6 is generally made integrally with a base which is in contact with the wall surface. In light of the fastening body 6 being an integral part of the base, the bathrobe rack is not cost-effective.

SUMMARY OF THE INVENTION

The primary objective of the present invention is to provide a bathroom rack comprising a base, a holding rod, and a cover. The base is provided in the outer side thereof with a protrusion which is provided with two first retaining portions opposite in location to each other. The holding rod is curved and is provided with two second retaining portions. The holding rod is retained by the base such that the two first retaining portions are retained in the two second retaining portions. The base is further provided in the protrusion thereof with a threaded rod. The cover is provided with a threaded hole and is joined with the base such that the threaded hole of the cover is engaged with the threaded rod of the protrusion of the base. The cover may be provided with a grooved rim which is provided with a plurality of tools holes engageable with the fastening tools used to turn and tighten the cover. The grooved rim of the cover may be provided with a ring which is intended to conceal the tool holes of the grooved rim.

The foregoing objective, features, functions, and advantages of the present invention will be more readily understood upon a thoughtful deliberation of the following detailed description of the preferred embodiments of the present invention with reference to the accompanying drawings.

BRIEF DESCRIPTION OF THE DRAWINGS

FIG. 3-1 shows an exploded view of a bathroom rack of a first preferred embodiment of the present invention.

FIG. 3-2 shows a perspective view of the bathroom rack of the first preferred embodiment of the present invention in combination.

FIG. 3-3 shows a schematic view of the present invention in conjunction with a hand tool.

FIG. 4-1 shows an exploded view of a bathroom rack of a second preferred embodiment of the present invention.

FIG. 4-2 shows a schematic view of the bathroom rack of the second preferred embodiment of the present invention in combination.

FIG. 5-1 shows an exploded view of a bathroom rack of a third preferred embodiment of the present invention.

FIG. 5-2 shows a schematic view of the bathroom rack of the third preferred embodiment of the present invention.

FIG. 6-1 shows an exploded view of a bathroom rack of a fourth preferred embodiment of the present invention.

FIG. 6-2 shows a schematic view of the bathroom rack of the fourth preferred embodiment of the present invention in combination.

FIG. 7-1 shows an exploded view of a bathroom rack of a fifth preferred embodiment of the present invention.

FIG. 7-2 shows a schematic view of the bathroom rack of the fifth preferred embodiment of the present invention in combination.

DETAILED DESCRIPTION OF THE EMBODIMENTS

Figure 1:
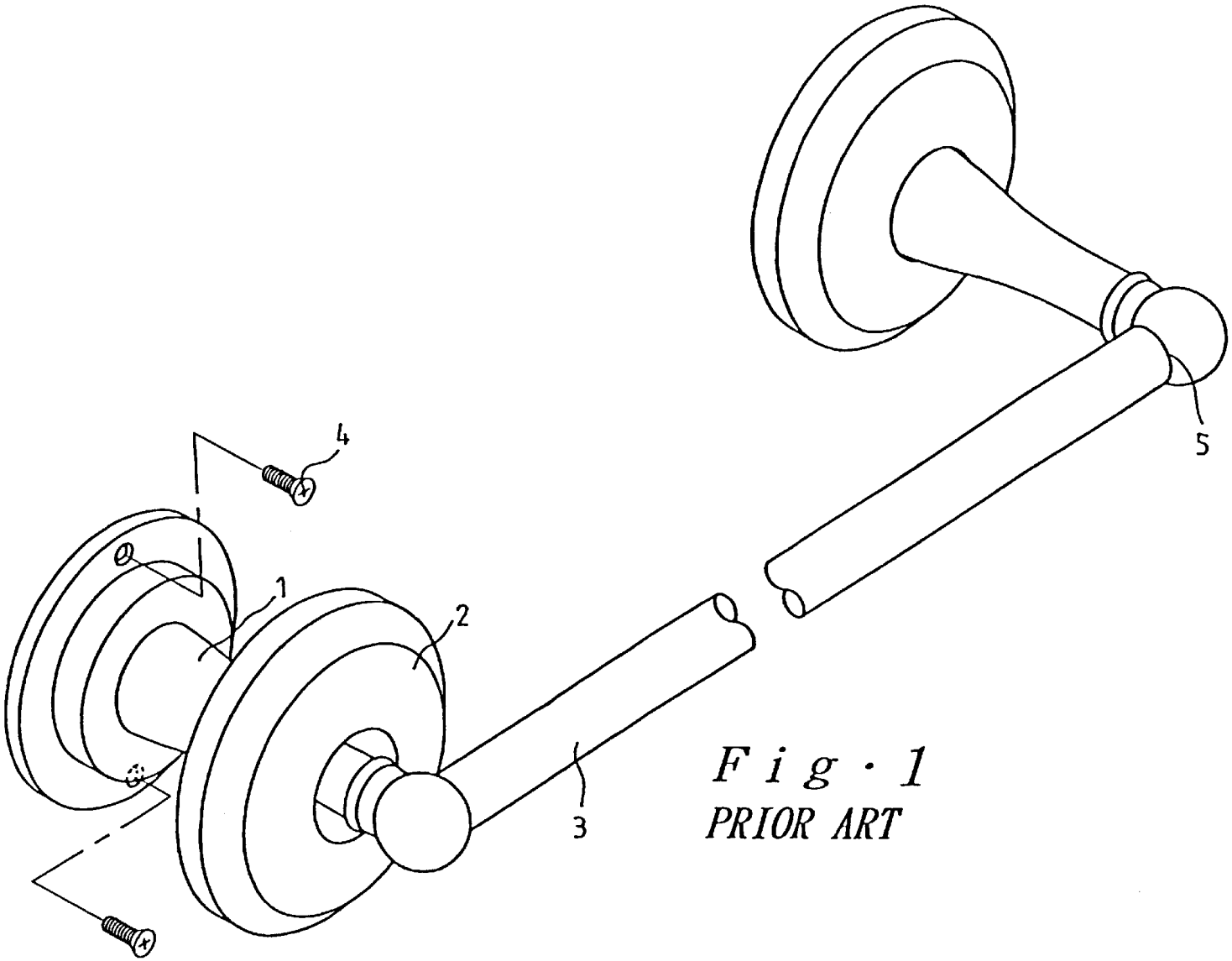
Fig. 1 PRIOR ART
FIG. 1 shows a schematic view of a bathroom rack of the prior art.
Figure 2:
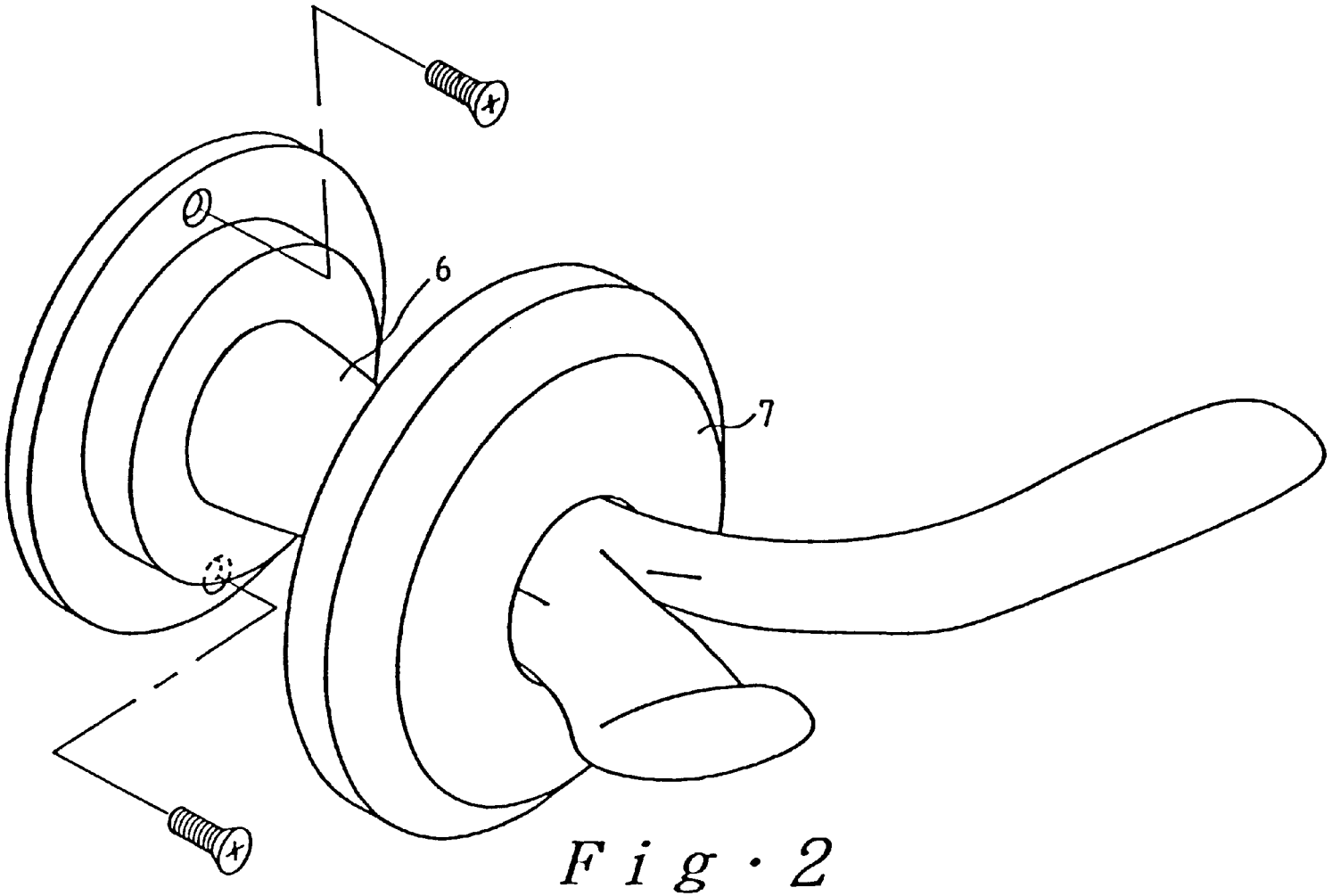
Fig. 2 PRIOR ART
FIG. 2 shows a schematic view of another bathroom rack of the prior art.
Figures 1, 3:
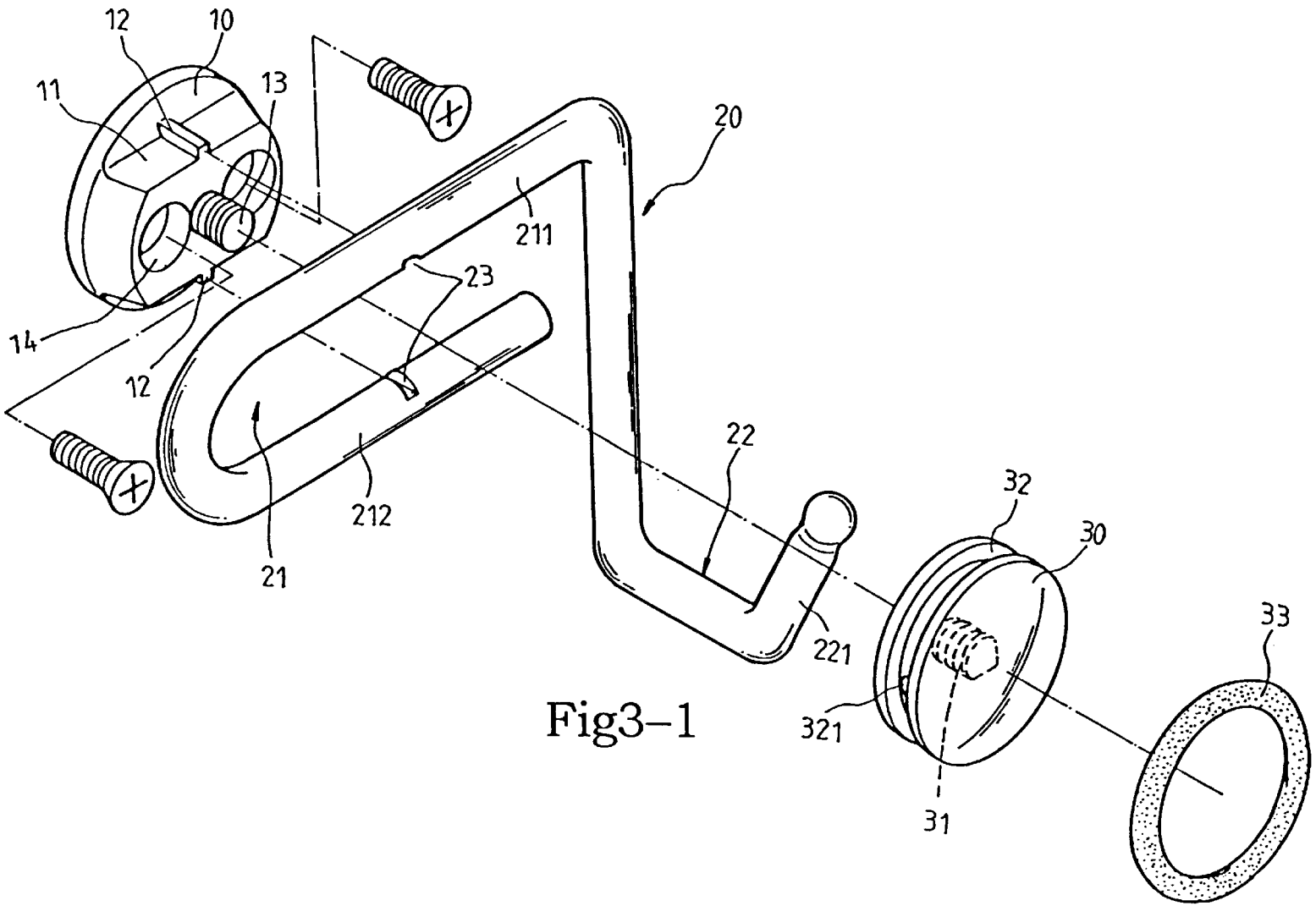
Figures 2, 3:
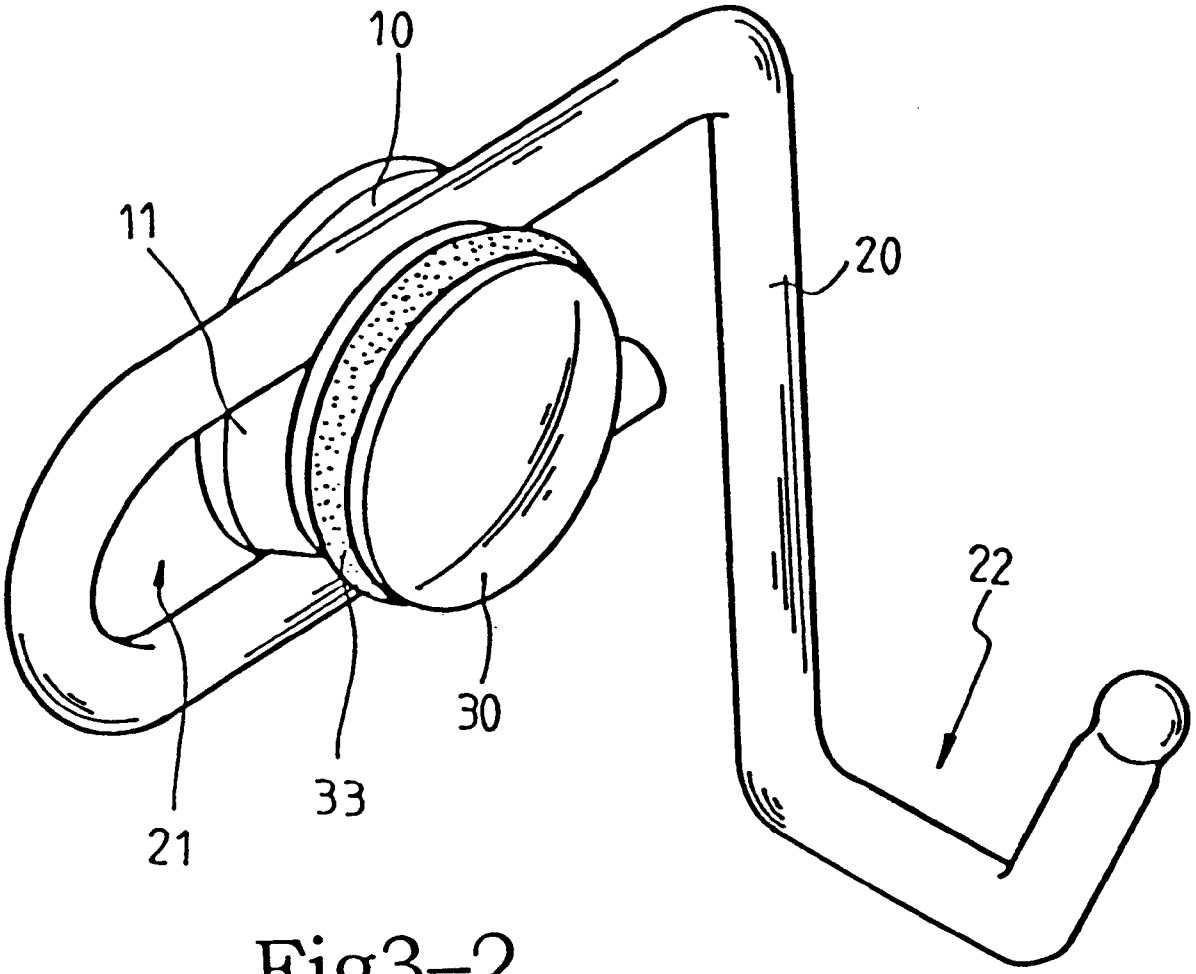
Figure 3:
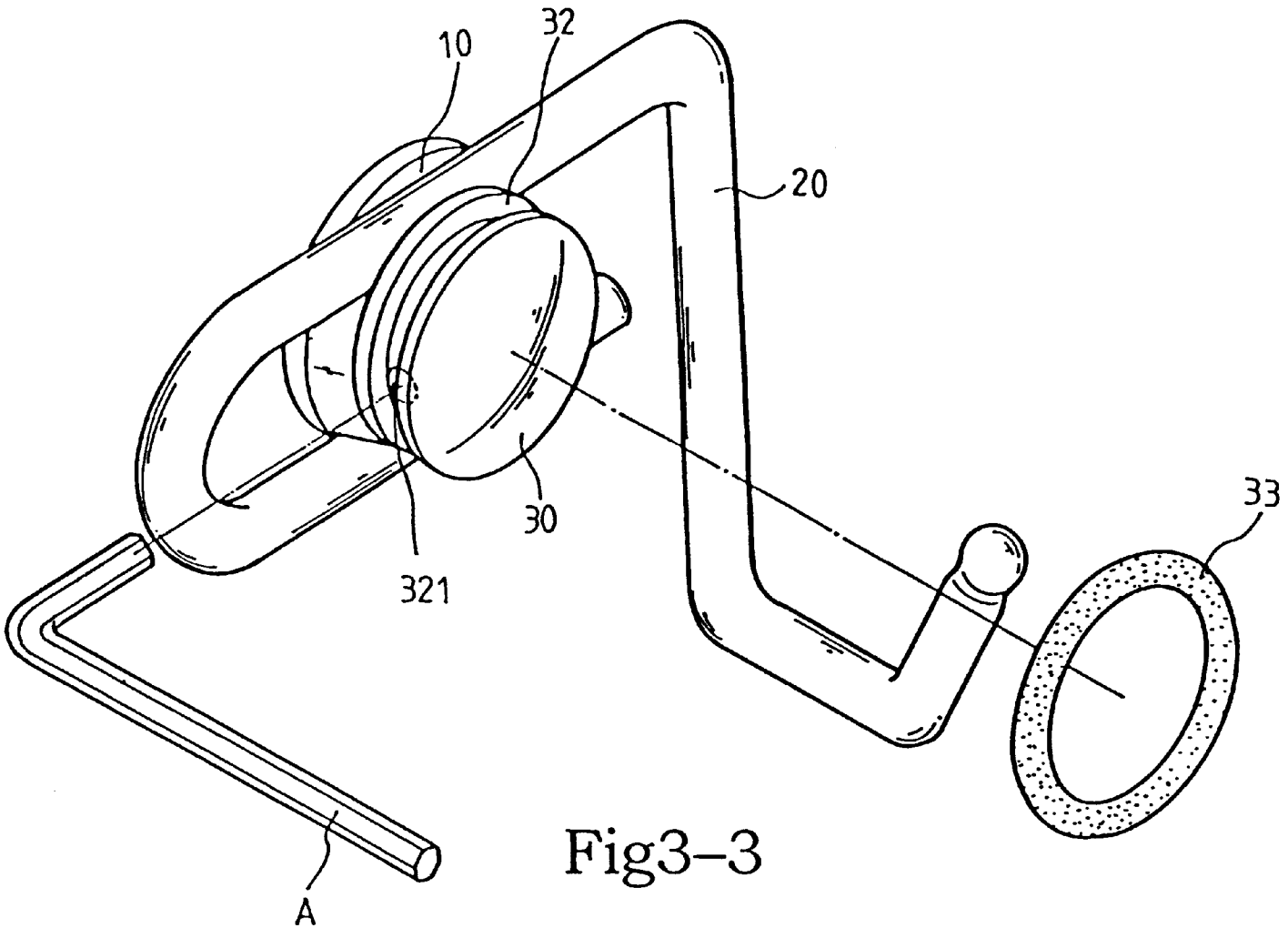

As shown in FIGS. 3-1, 3-2, and 3-3, a bathroom rack embodied in the present invention comprises a base 10, an article holding rod 20, and a cover 30.

The base 10 is provided in the outer side thereof with a protrusion 11 which is in turn provided with two first retaining portions 12 opposite in location to each other. The retaining portions 12 embodied in the present invention are of a protruded block. The base 10 is further provided in the outer side thereof with a threaded rod 13 fastened in the inner side thereof with the bathroom wall by two fastening bolts which are fastened onto the bathroom wall via the two through holes 14.

The holding rod 20 is so curved that both ends of the holding rod 20 are U-shaped. The fastening end of the holding rod 20 has two arms 211, 212, and a space 21 located between the two arms 211 and 212. The space 21 is so dimensioned as to enable the two arms 211 and 212 to embrace the protrusion 11 of the base 10. Both arms 211 and 212 are provided with a second retaining portion 23, which is a retaining slot corresponding in location to the first retaining portion 12 of the base 10. The fastening end of the holding rod 20 is secured to the base 10 such that the two first retaining portions 12 are retained securely in the two second retaining portions 23 of the holding rod 20. The holding rod 20 has a holding end 22 with a stop rod 221.

The cover 31 is provided in the inner side thereof with a threaded hole 31 corresponding in location to and engageable with the threaded rod 13 of the base 10. The cover 31 is joined with the base 10 such that the cover 30 is engaged with the threaded rod 13 of the base 10. The cover 30 is provided in the rim thereof with a groove 32 which is in turn provided with a plurality of tool holes 321 which are intended to engage a hand tool "A" for tightening the cover 30. The groove 32 is provided with a ring 33 of various colors. The ring 33 is intended to conceal the tool holes 321.

Figures 1, 4:
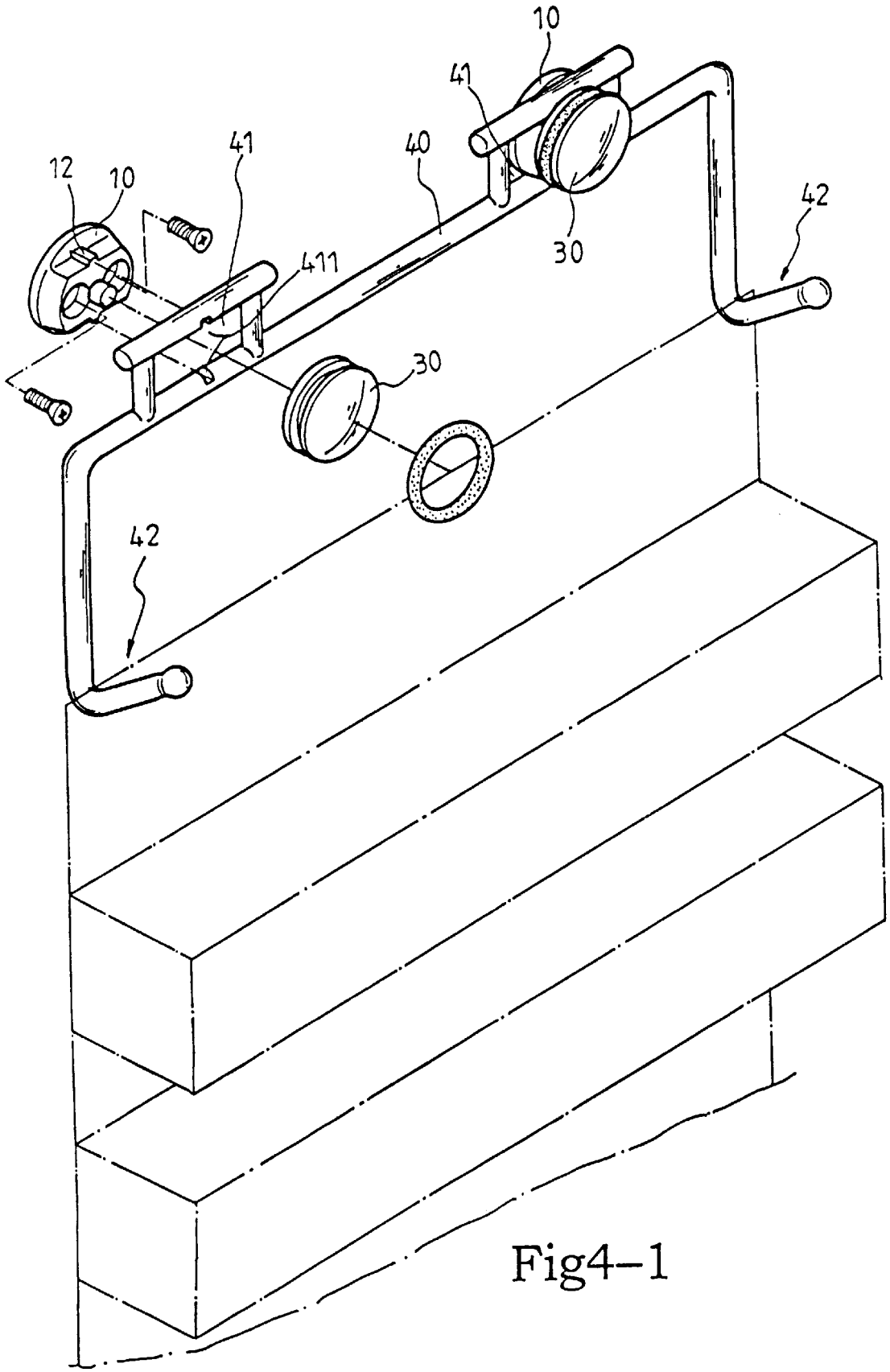
Figures 2, 4:
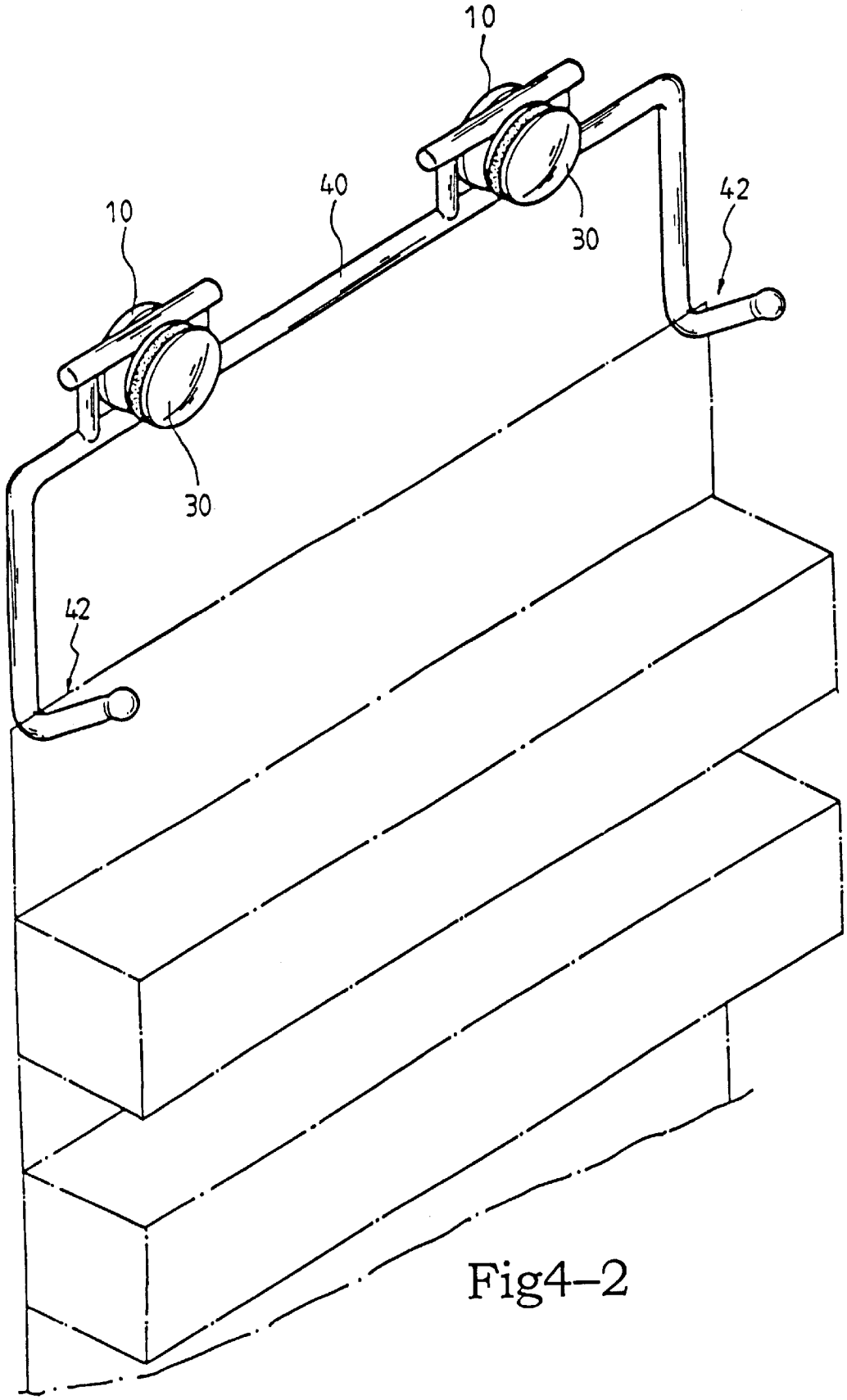

As shown in FIGS. 4-1 and 4-2, a bathroom rack of the second preferred embodiment of the present invention comprises two bases 10, a holding rod 40, and two covers 30. The bases 10 and the covers 30 of the second preferred embodiment of the present invention are basically similar in structure and function to the base 10 and the cover 30 of the first preferred embodiment of the present invention. The holding rod 40 has two hooked ends 42 and two retaining portions 41, each having a retaining slot 411 to enable the retaining portion 41 to fasten with the base 10 such that the protruded block 12 of the base 10 is retained in the retaining slot 411 of the retaining portion 41 of the holding rod 40.

Figures 1, 5:
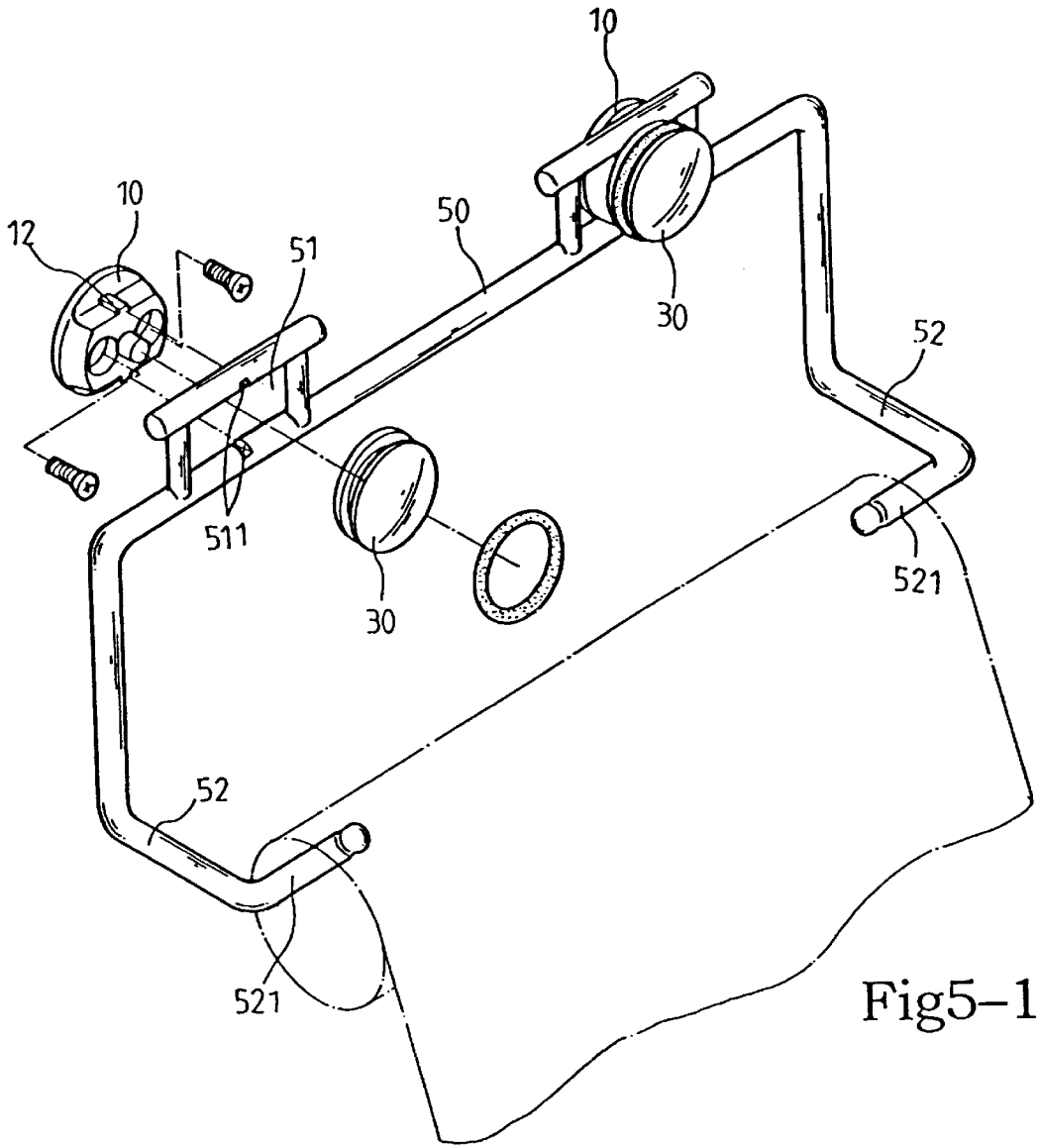
Figures 2, 5:
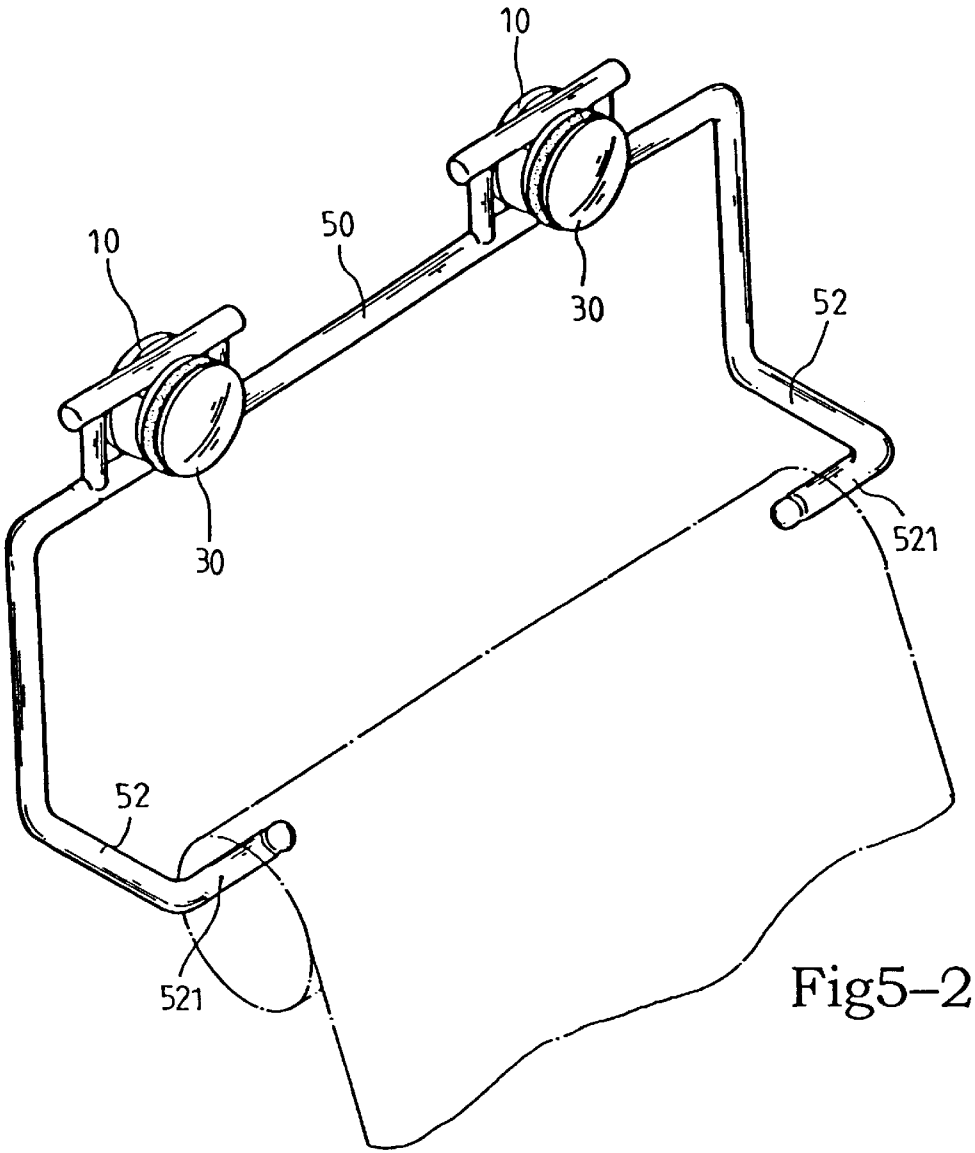

As shown in FIGS. 5-1 and 5-2, a bathroom rack of the third preferred embodiment of the present invention is intended to hold a paper towel roll and is formed of two bases 10, a holding rod 50, and two covers 30. The bases 10 and the covers 30 of the third preferred embodiment of the present invention are basically similar in structure and finction to the base 10 and the cover 30 of the first preferred embodiment of the present invention. The holding rod 50 has two holding ends 521 for holding the paper towel roll, and two retaining portions 51, each having two retaining slots 511 to enable the retaining portion 51 to fasten with the base 10 such that the protruded blocks 12 of the base 10 are retained in the retaining slots 511 of the retaining portion 51 of the holding rod 50.

Figures 1, 6:
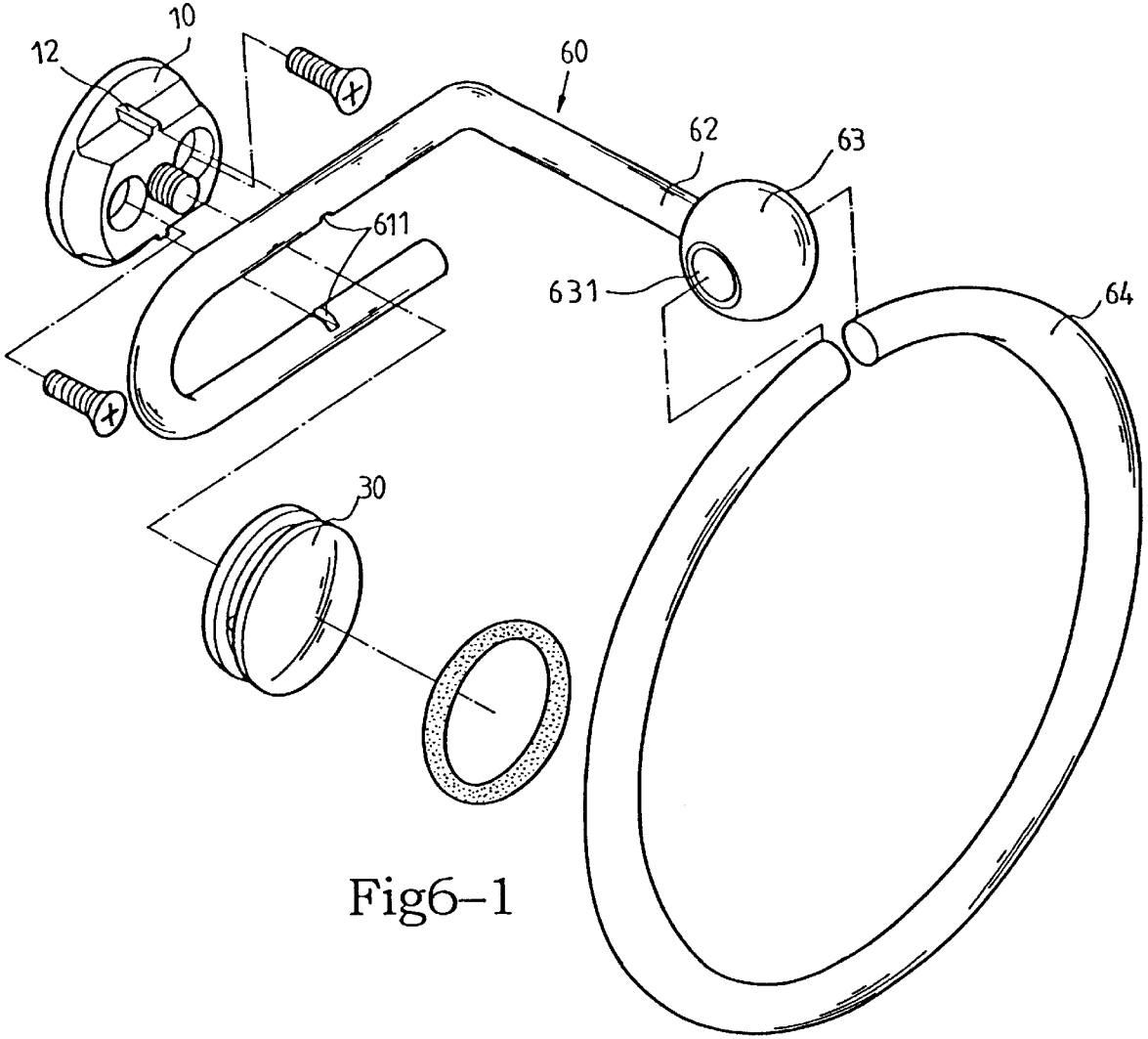
Figures 2, 6:
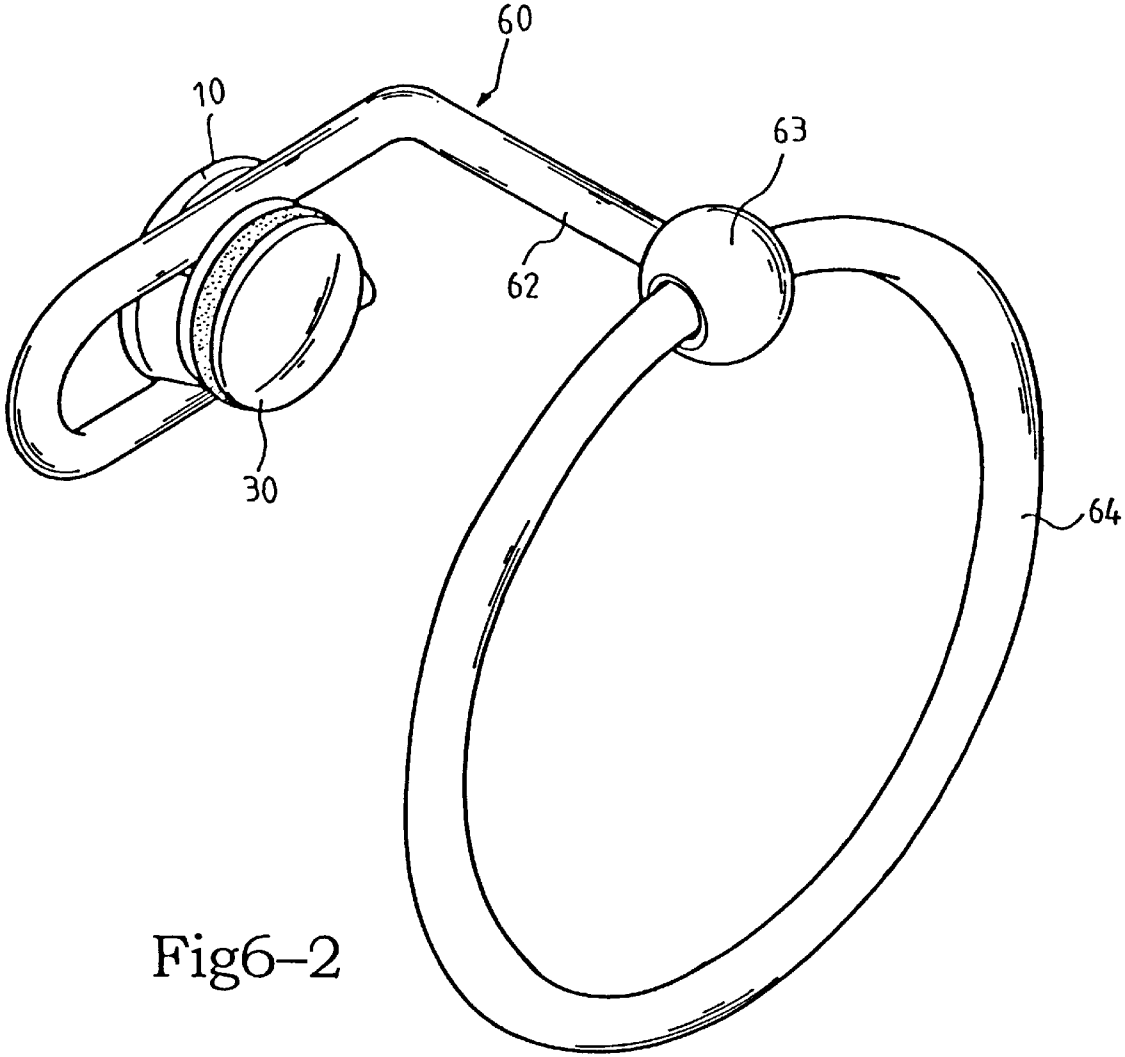

As shown in FIGS. 6-1 and 6-2, a bathroom rack of the fourth preferred embodiment of the present invention is designed to hold a washcloth and the like and is formed of a base 10, a cover 30, a holding rod 60, and a ring 64. The base 10 and the cover 30 are basically similar in structure and finction to the base 10 and the cover 30 of the first preferred embodiment of the present invention. The holding 60 has a U-shaped fastening end which is provided with two retaining slots 611 to enable the fastening end of the holding rod 60 to fasten with the base 10 such that the protruded blocks 12 of the base 10 are retained in the retaining slots 611. The holding rod 60 has a connection end 62 which is provided with a connection portion 63 of a spherical construction and having a through hole 631 for receiving the ring 64.

Figures 1, 7:
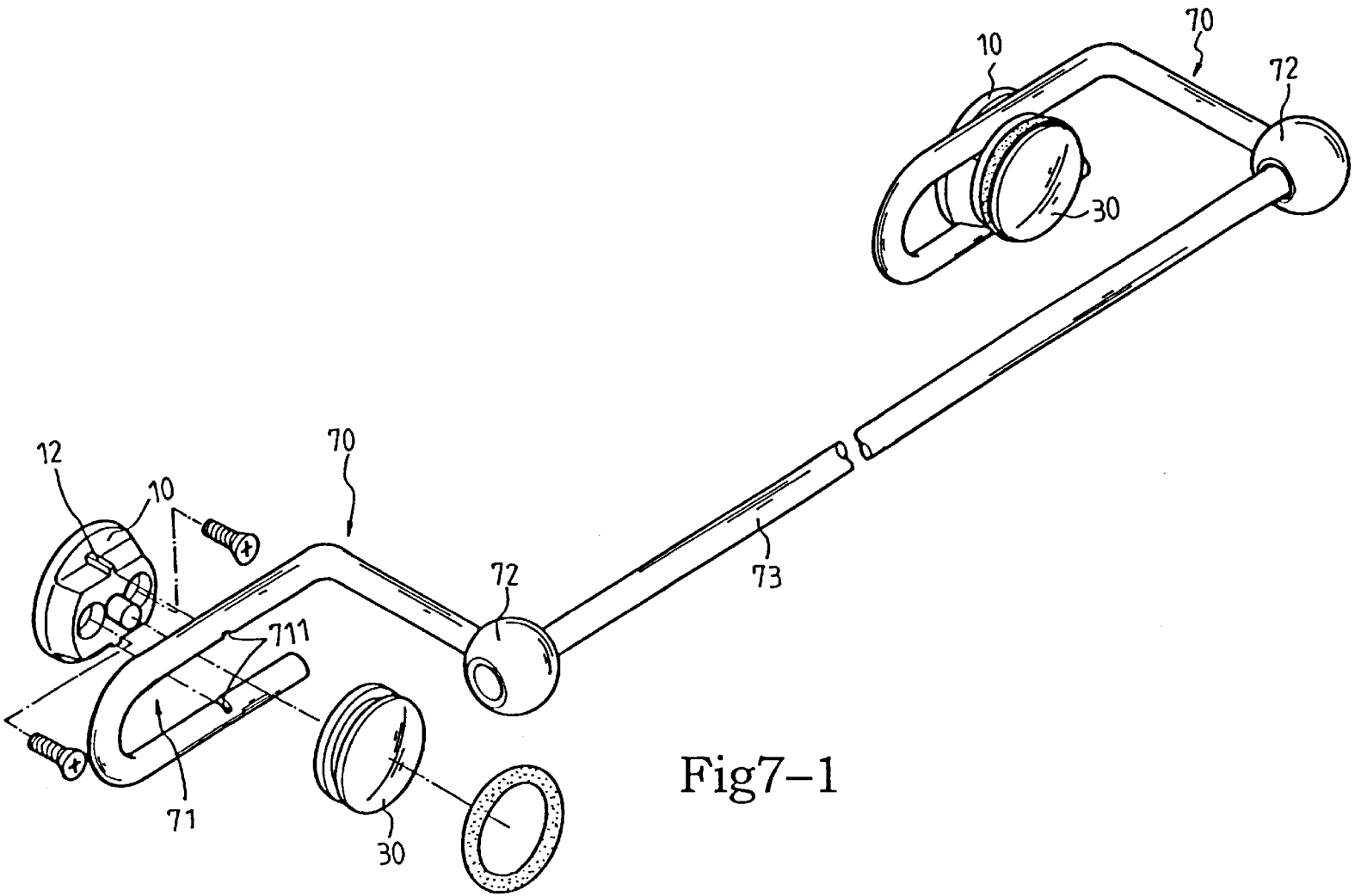
Figures 2, 7:
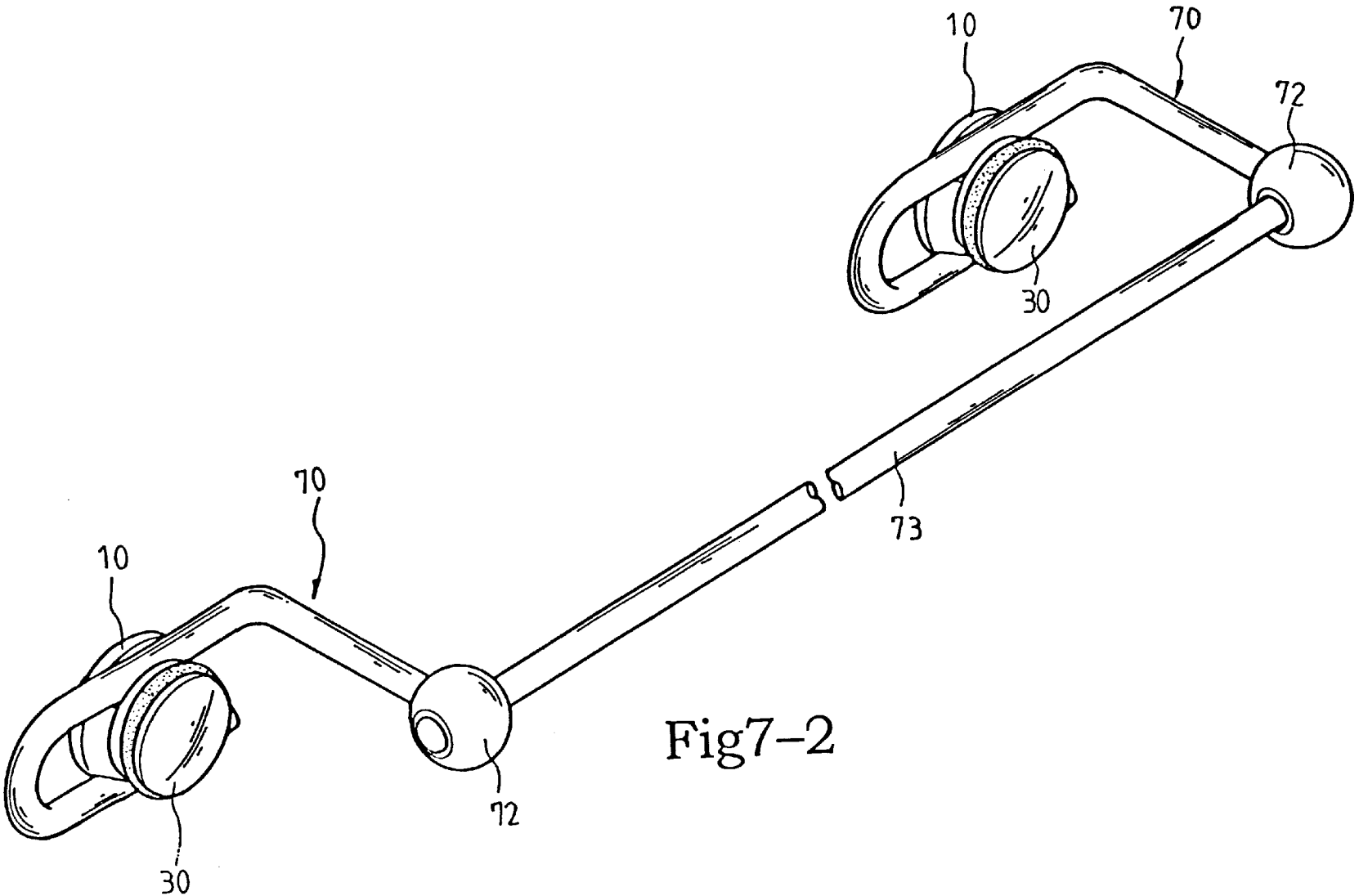

Now referring to FIGS. 7-1 and 7-2, a towel rack of the fifth preferred embodiment of the present invention is shown comprising two bases 10, two covers 30, two holding rods 70, and a towel holding rod 73. The bases 10 and the covers 30 are similar in structure and function to the base and the cover of the first preferred embodiment of the present invention. The two holding rods 70 are identical in construction to each other and have a fastening end 71 of a U-shaped construction. The fastening end 71 is provided with two retaining slots 711 and is fastened with the base 10 such that the two protruded blocks 12 of the base 10 are retained in the retaining slots 711 of the fastening end 71. The holding rods 70 have a connection end which is provided with a connection member 72 of a spherical construction and having a retaining hole for retaining one end of the towel holding rod 73.

Figure 8:
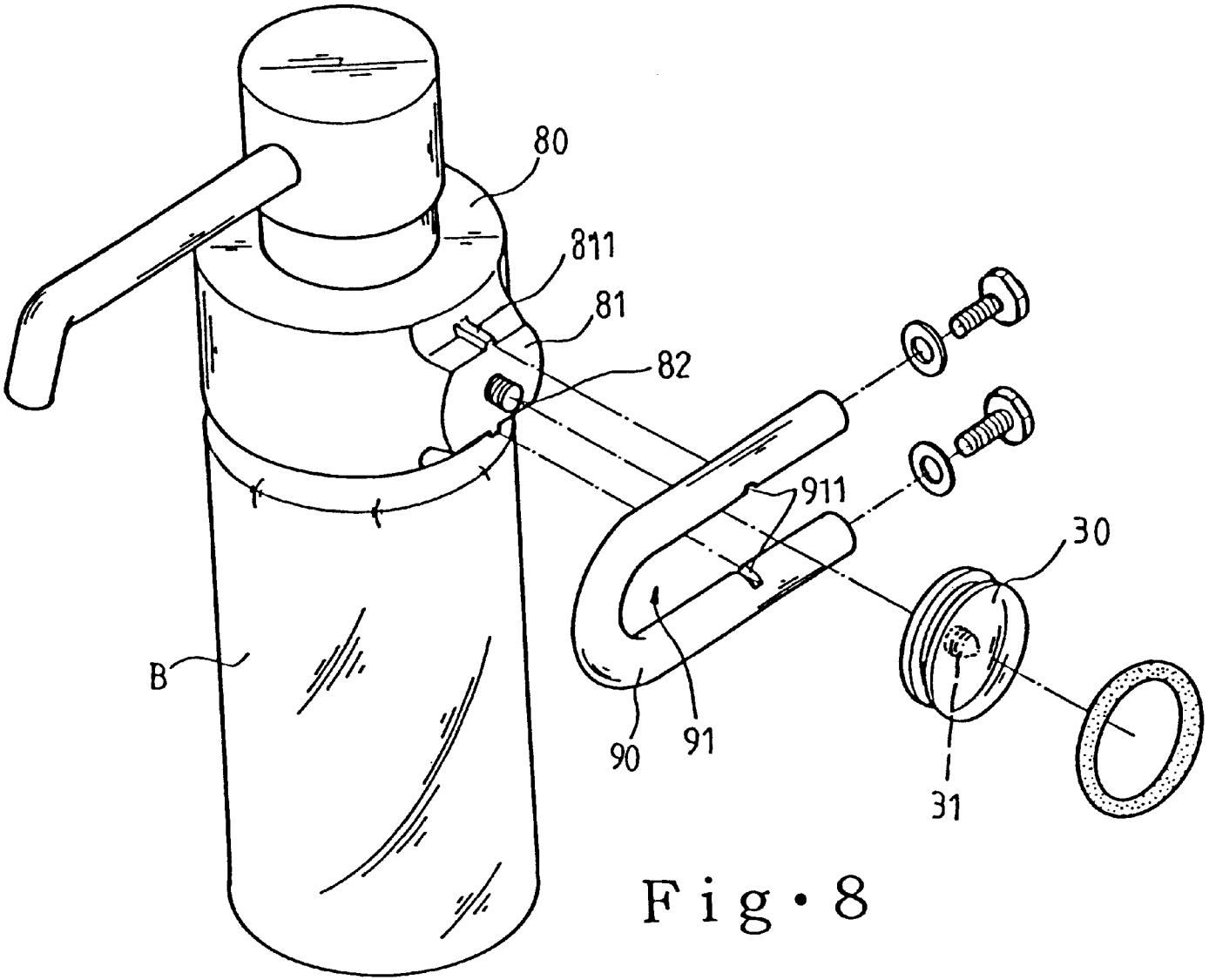
FIG. 8 shows an exploded view of a bathroom rack of a sixth preferred embodiment of the present invention.
Figure 9:
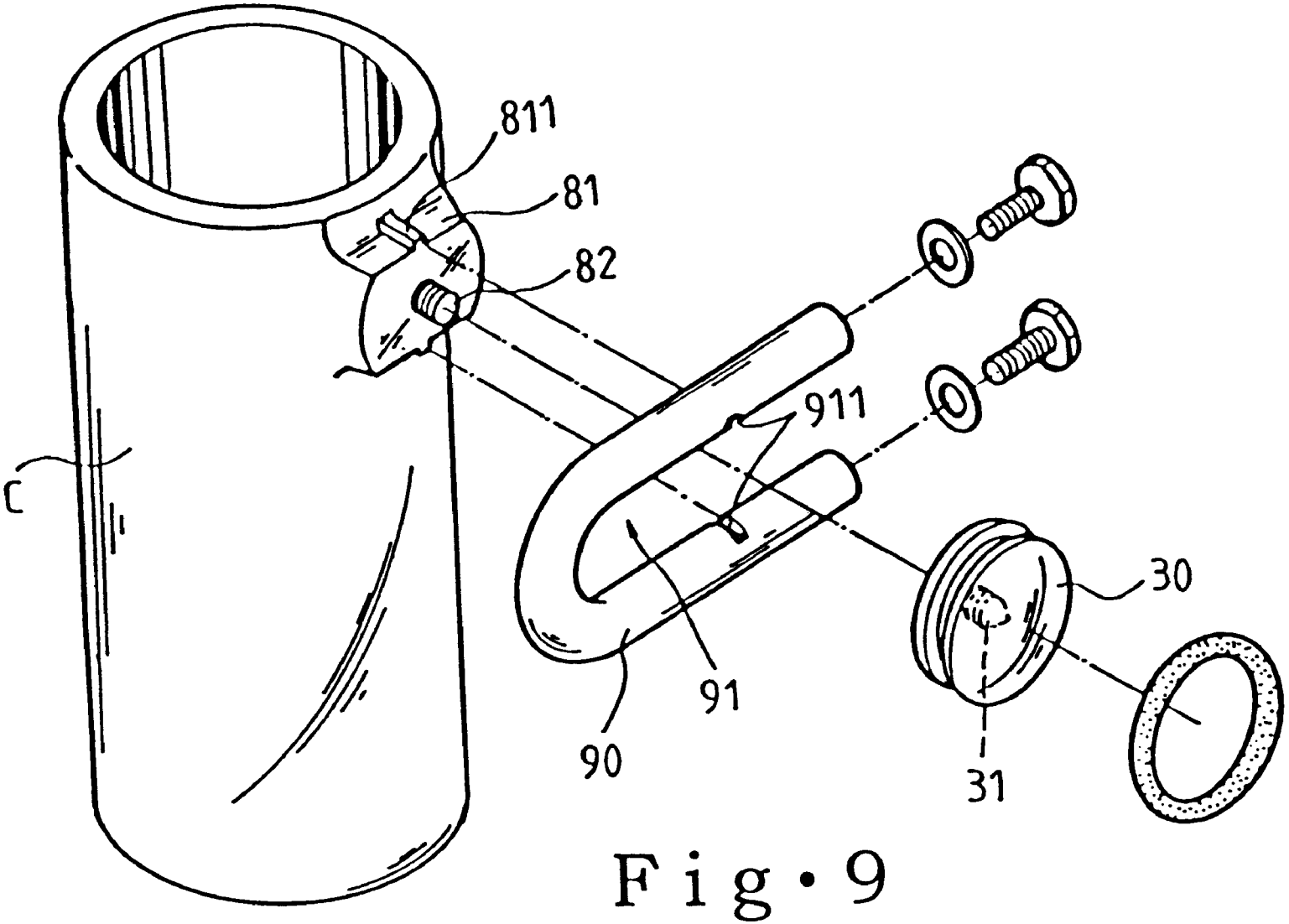
FIG. 9 shows an exploded view of a bathroom rack of a seventh preferred embodiment of the present invention.

As shown in FIG. 8, a bathroom rack of the present invention is used to stabilize a liquid soap dispenser "B". Similarly, the bathroom rack of the present invention is used to stabilize a cup holder "C" and the like, as shown in FIG. 9. The bathroom rack of the present invention comprises a base 80, a holding rod 90, and a cover 30. The base 80 is fastened with the liquid soap dispenser "B" and is provided with a protrusion 81, and a threaded rod 82. The protrusion 81 is provided with two protruded blocks 811. The holding rod 90 is of a U-shaped construction and is provided with two retaining slots 911. The holding rod 90 is provided between two arms thereof with a space 91 for accommodating the protrusion 81 of the base 80. The holding rod 90 is fastened with the base 80 such that the protrusion 81 of the base 80 is received in the space 91, and that the two protruded blocks 811 are retained in the retaining slots 911 of the holding rod 90. The holding rod 90 is fastened to the bathroom wall by a plurality of fastening bolts. The cover 30 is provided with a threaded hole 31. The cover 30 is joined with the base 80 such that the threaded hole 31 is engaged with the threaded rod 82 of the base 80.

What is claimed is:

1. A bathroom rack comprising:

a base provided with a protrusion having a plurality of first retaining portions formed by protruding blocks, said base further provided with a plurality of through holes for receiving fastening bolts which are used to fasten the base to a wall, wherein the protrusion has a first surface and a second surface, the first surface and the second surface are substantially flat and substantially parallel with each other, and at least one of the protruding blocks is formed on the first surface and at least one of the protruding blocks is formed on the second surface;

a holding rod having a fastening end and an article holding end, said fastening end provided with a plurality of second retaining portions formed by slots and fastened with said base such that said second retaining portions are engaged with said first retaining portions, wherein the fastening end has a first arm and a second arm, at least one of the slots is formed on the first arm and at least one of the slots is formed on the second arm, and wherein a longitudinal axis of the slots is substantially perpendicular to a longitudinal axis of the first arm and a longitudinal axis of the second arm; and a cover joined with said base such that said fastening end of said holding rod is located between said base and said cover.

2. The bathroom rack as defined in claim 1, wherein said protrusion of said base is provided with a threaded rod fastened therewith; wherein said cover is provided with a threaded hole corresponding in location to and engagable with said threaded rod of said base; and wherein said cover is joined with said base such that said threadable hole of said cover is engaged with said threaded rod of said base.

3. The bathroom rack as defined in claim 2, wherein said cover is provided in a rim thereof with a groove extending around the periphery of the rim whereby said groove is provided with a plurality of holes directed toward the center of the cover and connected with the threaded hole and engageable with a hand tool for fastening the cover to the base.

4. The bathroom rack as defined in claim 3, wherein said cover is provided with a ring whereby said ring is received in said groove of said cover.

5. The bathroom rack as defined in claim 1, wherein said fastening end of said holding rod is formed by bending the holding rod into a U-shaped construction with two arms, and the two arms define the first arm and the second arm of the fastening end.

6. The bathroom rack as defined in claim 1, wherein said article holding end of said holding rod is provided with a stop rod.

7. The bathroom rack as defined in claim 1, wherein said article holding end of said holding rod is provided with a connection member having a retaining hole for retaining a means for holding an article.

8. A bathroom rack comprising:

a holding rod for holding an article, the holding rod having a U-shaped fastening portion formed by bending the holding rod, the U-shaped fastening portion having two arms, each of the two arms having an engaging slot formed thereon, wherein a longitudinal direction of the engaging slot is substantially perpendicular to a longitudinal direction of the two arms of the fastening portion;

a base with a protrusion for receiving the holding rod, the protrusion having an engaging block protruding outwardly from the protrusion, wherein the engaging block corresponds to and, when installed, engages with one of the engaging slots; and, a cover for joining with the base such that, when installed, the fastening portion of the holding rod is located between the base and the cover and received by the protrusion of the base.

9. The bathroom rack of claim 8, wherein, when viewed along a first axis defined through a center of the base, the protrusion of the base has a truncated disk shape with two truncated portions opposite to each other each of the two truncated portions defines a surface substantially parallel with the first axis, the surfaces of the two truncated portions are substantially parallel with each other, and wherein each of the surfaces of the truncated portions has at least one said engaging block protruding outwardly therefrom for engaging with the engaging slot of the two arms of the U-shaped fastening portion.

10. A bathroom rack comprising:

a base with a protrusion projected outwardly from the base along a first axis, the protrusion having a first surface and a second surface, wherein the first surface and the second surface are substantially parallel with the first axis and with each other, and positioned substantially opposite to each other, the first surface has a first engaging block projected outwardly therefrom and the second surface has a second engaging block projected outwardly therefrom;

a holding rod having a fastening portion, the fastening portion having a first elongated engaging arm and a second elongated engaging arm, the first elongated engaging arm having a first engaging slot for engaging with the first engaging block, the second elongated engaging arm having a second engaging slot for engaging with the second engaging block, wherein a longitudinal direction of the first engaging slot is substantially perpendicular to a longitudinal direction of the first elongated engaging arm, a longitudinal direction of the second engaging slot is substantially perpendicular to a longitudinal direction of the second elongated engaging arm; and, a cover for joining with the base such that, when installed, the fastening portion of the holding rod is located between the base and the cover and received by the protrusion of the base.

11. The bathroom rack of claim 10, wherein the first surface and the second surface of the protrusion are substantially flat.

12. The bathroom rack of claim 10, wherein the first elongated engaging arm and the second elongated engaging arm are substantially parallel with each other.

13. The bathroom rack of claim 10, wherein the fastening portion is formed by bending the holding rod into a U-shape, and the two arms of the U-shaped holding rod define the first elongated engaging arm and the second elongated engaging arm of the fastening portion, respectively.

* * * * *